US007766192B2

(12) United States Patent
Lecoutre et al.

(10) Patent No.: US 7,766,192 B2
(45) Date of Patent: Aug. 3, 2010

(54) FLUID PRODUCT DISPENSING ASSEMBLY

(75) Inventors: Jean-Paul Lecoutre, Breteuil sur Iton (FR); Alex Milian, Breteuil sur Iton (FR)

(73) Assignee: Valois S.A.S., Le Neubourg (FR)

( * ) Notice: Subject to any disclaimer, the term of this patent is extended or adjusted under 35 U.S.C. 154(b) by 821 days.

(21) Appl. No.: 10/577,051

(22) PCT Filed: Oct. 21, 2004

(86) PCT No.: PCT/FR2004/050521

§ 371 (c)(1),
(2), (4) Date: Apr. 24, 2006

(87) PCT Pub. No.: WO2005/042371

PCT Pub. Date: May 12, 2005

(65) Prior Publication Data

US 2007/0068968 A1 Mar. 29, 2007

(30) Foreign Application Priority Data

Oct. 24, 2003 (FR) ..... 03 12462

(51) Int. Cl.
*B67D 7/84* (2010.01)

(52) U.S. Cl. ..... 222/173; 222/179.5; 222/183; 206/464

(58) Field of Classification Search ..... 222/105, 222/182, 183, 173, 179.5, 192; 206/461, 206/463, 464, 495; 215/12.1
See application file for complete search history.

(56) References Cited

U.S. PATENT DOCUMENTS

| | | | | | |
|---|---|---|---|---|---|
| 3,698,551 | A * | 10/1972 | Tomlinson | 206/489 |
| 3,942,667 | A * | 3/1976 | Thomas | 215/12.1 |
| 4,371,087 | A * | 2/1983 | Saujet | 215/12.1 |
| 4,998,621 | A * | 3/1991 | Meehan | 206/466 |
| 5,125,397 | A | 6/1992 | Mayled | |
| 5,152,397 | A | 10/1992 | Mayled | |
| 5,474,212 | A * | 12/1995 | Ichikawa et al. | 222/105 |
| 5,839,609 | A * | 11/1998 | Zakensberg | 222/107 |
| 6,478,195 | B2 * | 11/2002 | Duquet et al. | 222/183 |
| 2003/0102241 | A1 * | 6/2003 | Aylesworth et al. | 206/461 |

FOREIGN PATENT DOCUMENTS

| | | | |
|---|---|---|---|
| DE | 9203387 | U | 7/1992 |
| FR | 1346389 | A | 12/1963 |
| FR | 2826944 | A | 1/2003 |

OTHER PUBLICATIONS

International Preliminary Report on Patentability for PCT/FR2004/050521.

* cited by examiner

*Primary Examiner*—Kevin P Shaver
*Assistant Examiner*—Daniel R Shearer
(74) *Attorney, Agent, or Firm*—Sughrue Mion, PLLC

(57) ABSTRACT

A fluid dispenser assembly comprising a fluid dispenser (101), a pack (120) for co-operating with the dispenser in such a manner as to fasten the pack to the dispenser, the pack including a fastener zone, and the dispenser including reception means for receiving the fastener zone, the assembly being characterized in that the reception means comprise at least one set of two opposite longitudinal grooves (111) for receiving the fastener zone (121) of the pack.

19 Claims, 6 Drawing Sheets

Fig. 2c
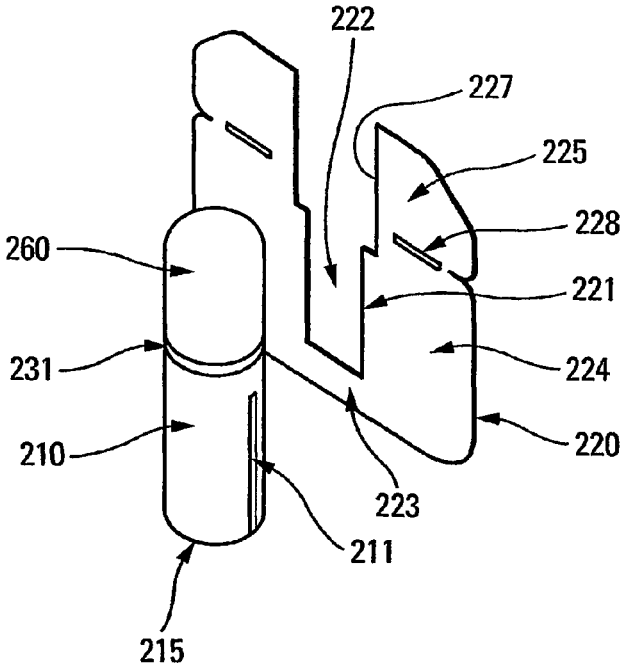
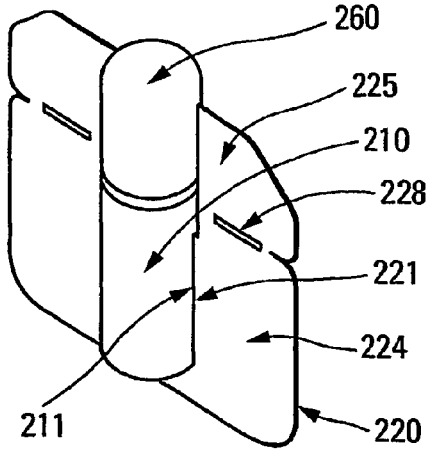
Fig. 2d
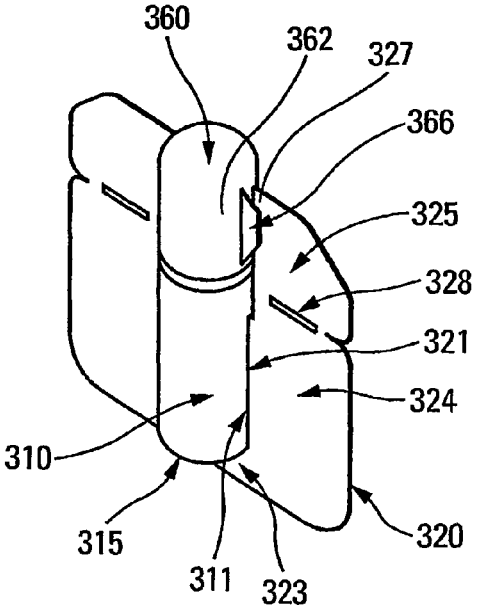
Fig. 3a
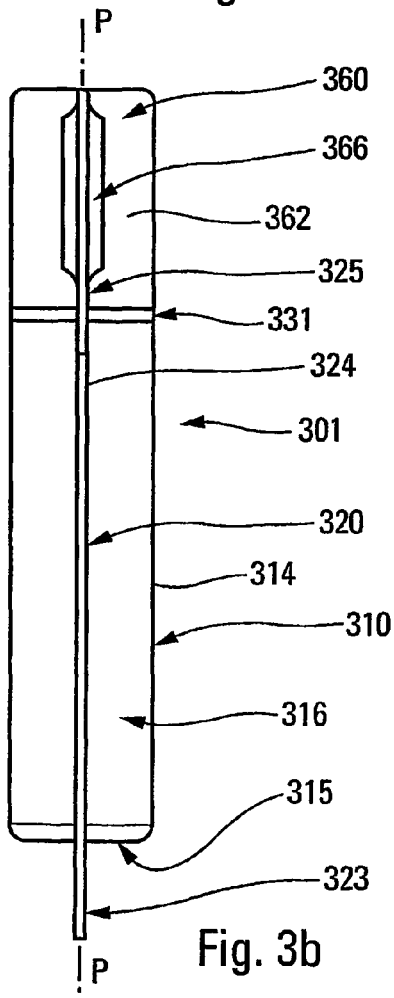
Fig. 3b

FLUID PRODUCT DISPENSING ASSEMBLY

BACKGROUND OF THE INVENTION (1) Field of the Invention

The present invention relates to a fluid dispenser assembly comprising a fluid dispenser and a pack for co-operating with the dispenser in such a manner as to fasten the pack to the dispenser. The term "fluid" refers to any liquid, paste, or even powder that is suitable for being applied to an application surface or for being dispensed into the atmosphere. In particular, this type of dispenser assembly is found in the fields of pharmacy, cosmetics, or even perfumery.

(2) Description of related art

In the prior art, document FR 2 784 361 describes fluid packaging comprising a dispenser having deformable actuator walls surrounded by a pack making it possible to actuate the wall of the dispenser. However, the dispenser in that document presents a configuration that is substantially flat or thin. On one side, the dispenser is completely plane, whereas on the other side, it forms a convex dome defining the depressable actuator wall. Thus, by pressing on the actuator wall, e.g. by means of a finger of one hand, the internal volume of the reservoir of the dispenser can be reduced, and a fraction of the fluid that it contains can thus be delivered mixed with a gas, e.g. air. A mixture of fluid and air is thus sprayed from the outlet of the dispenser. The pack extends over at least the reservoir of the dispenser in the form of a flap that covers the actuator wall. In cross-section, the pack is in the form of a segment of a cylinder. In other words, the flap that covers the actuator wall presents a curved configuration, whereas the other portion of the pack merely covers the plane rear face of the dispenser. The pack is in contact with, and fastened to, the dispenser at the rear face and/or at the edges of the front face defining the actuator wall. That is a particular type of dispenser assembly implementing a particular dispenser and a specially adapted pack. It is particularly suitable for a sample dispenser.

BRIEF SUMMARY OF THE INVENTION

An object of the present invention is to define another type of dispenser assembly that is also formed by a dispenser and by a pack. However, the pack is not a covering like a case or a box, but rather surrounds the dispenser in such a manner as to leave it visible at least in part. Another object is to make it possible to assemble the pack on the dispenser in simple and rapid manner, advantageously in a single operation. Furthermore, another object of the invention is to make it easier to apply markings.

To achieve these objects, the present invention proposes a fluid dispenser assembly comprising a fluid dispenser, a pack for co-operating with the dispenser in such a manner as to fasten the pack to the dispenser, the pack including a fastener zone, and the dispenser including reception means for receiving the fastener zone, the assembly being characterized in that the reception means comprise at least one set of two opposite longitudinal grooves for receiving the fastener zone of the pack.

The reception means and the fastener zone advantageously extend in a fastener plane.

According to another characteristic, the dispenser presents a longitudinal axis that extends in said fastener plane.

The dispenser advantageously presents a generally cylindrical shape defining a longitudinal axis of symmetry that extends in said fastener plane.

According to an advantageous characteristic, the pack is engaged into the grooves of the dispenser by sliding. The pack may be fastened into place in the grooves, or, in contrast, it may be removable by sliding.

According to another advantageous characteristic of the invention that could be protected independently, the pack includes a housing that is plane, at least in part, defining substantially plane edges forming the fastener zone.

The fastener zone preferably comprises two facing zone portions, defining between them a housing gap for co-operating with the reception means of the dispenser. The fastener zone advantageously comprises two housing gaps. The two housing gaps may extend in the same single fastener plane. In another aspect of the invention, the pack forms a closed housing that is in the form of a cut-out within the pack, the dispenser being completely surrounded by the pack. This characteristic makes it possible to guarantee first use of the dispenser, since the cap is blocked on the dispenser head by the portion of the pack that is situated thereon, thus making it inaccessible. Advantageously, the pack is plane and thin, and is made from a plane sheet. In another aspect of the invention, the dispenser includes a reservoir forming a body, the reception means being formed by said body. The dispenser may include a removable protective cap, the reception means being formed by said cap. The dispenser of the invention may advantageously include a reservoir having side walls, a bottom, and an opening, the side walls forming a set of two opposite longitudinal grooves that extend over at least a fraction of the height of the walls between the bottom and the opening. Each groove preferably comprises two substantially opposite longitudinal walls that are interconnected by a bottom core, said walls extending substantially in the fastener plane. Each groove may comprise a longitudinal access wall that extends substantially perpendicularly to the fastener plane. Each groove may be in the form of a V-groove defining a longitudinal fastener wall that extends substantially in the fastener plane, and an access wall that extends substantially perpendicularly to the fastener plane.

These walls thus makes it easier to mount the pack on the dispenser, that is fastened merely by pressing the pack against the walls of the dispenser, the pack thus snap-fastening into the grooves of the dispenser.

In another aspect of the invention, the pack may comprise two portions that are interconnected by a tear line, so that detaching the top portion of the pack clears the dispenser head so as to make it easier to actuate. According to an advantageous characteristic of the invention, the thickness of the pack is constant. The pack is advantageously fastened locally in permanent manner to the dispenser. This characteristic of the invention makes it possible to obtain a pack that is fastened securely to the dispenser, and that the user cannot remove. In a variant, the pack may be removed from the dispenser.

The pack may thus be in the form of a sheet that is rigid to a greater or lesser extent, and that defines a housing having edges that advantageously extend in a single plane. The edges come to be fastened in the grooves formed by the reservoir and/or the cap of the dispenser. The edges may be fastened merely by clamping in the grooves, but they may also be bonded in the grooves by adhesive or heat sealing. The pack is preferably completely plane, but it may however include a profiled portion or a portion in relief.

BRIEF DESCRIPTION OF THE DRAWINGS

The invention is described more fully below with reference to the accompanying drawings which show six embodiments of a dispenser assembly of the invention by way of non-limiting example.

In the figures:

FIG. 2*c* is a view of the FIG. 2*a* dispenser assembly, with the dispenser separate from its pack;

FIG. 2*d* is a perspective view of the FIG. 2*a* dispenser assembly;

FIG. 3*a* is a perspective view of a dispenser assembly constituting a third embodiment that includes a cap presenting reception means for receiving the pack;

FIG. 3*b* is a side view of the third embodiment;

DETAILED DESCRIPTION OF THE PREFERRED EMBODIMENTS

Figure 1A:
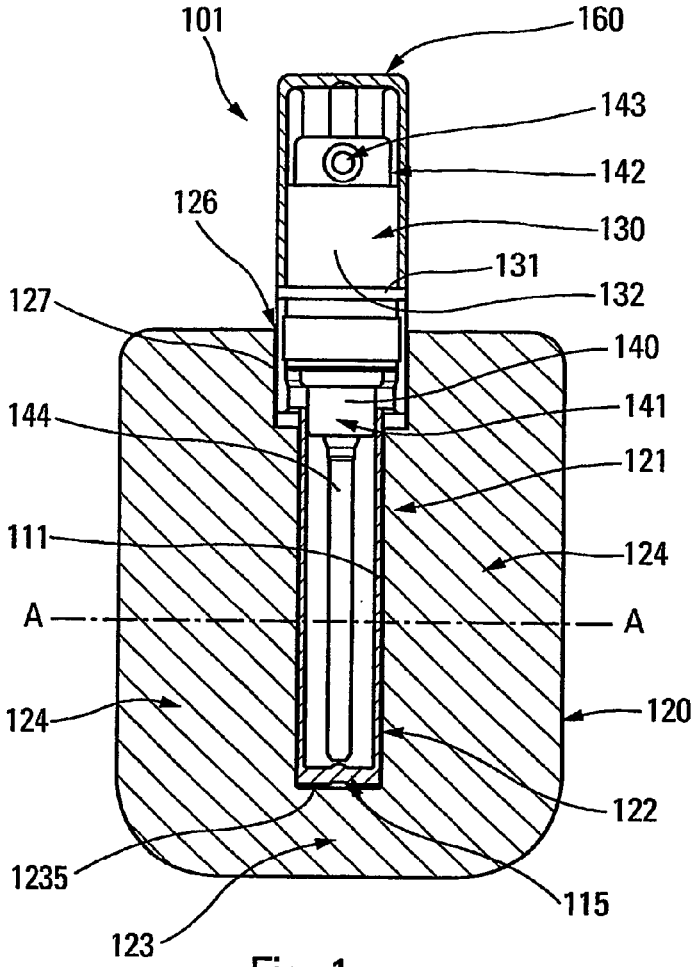
FIG. 1*a* is a front view of a dispenser assembly constituting a first embodiment of the invention.

In the six embodiments shown in the figures, the dispenser assembly comprises two component elements, namely a fluid dispenser, and a pack for co-operating with the dispenser in such a manner as to fasten the pack to the dispenser. It should be noted that the numerical references given in the description have one hundred added thereto for each successive embodiment, starting in the one hundreds for the first embodiment, and ending in the six hundreds for the sixth embodiment. The tens and units digits are identical for elements or zones that are identical or equivalent, with only the hundreds digit differing between embodiments.

The dispenser is respectively referenced 101, 201, 301, 401, 501, 601, and the pack is respectively referenced 120, 220, 320, 420, 520, 620 in the six embodiments. The dispensers 101, 201, and 401 are identical.

Reference is made firstly to FIGS. 1*a* to 1*d* in order to describe in detail the dispenser 101 and the pack 120 of the first embodiment.

The dispenser can be used as a sample, but this should not be considered as the only possible embodiment for the invention. The sample dispenser constitutes a preferred embodiment only.

The dispenser 101 comprises a reservoir 110, a dispenser member in the form of a pump 140, a fastener ring 130, and a removable cap 160. The ring 130 and the cap 160 are optional parts that can be omitted in some circumstances. The pump 140 can be mounted directly in the reservoir 110, and need not include a cap. The dispenser selected to illustrate the present invention, namely a pump 140, should not be considered as the only dispenser member that is possible in the context of the present invention. A dispenser endpiece of the applicator or closure type could equally well be used instead of the pump. A mere stopper that closes the reservoir could also be used as a dispenser member.

The reservoir 110 comprises a bottom 115, and a body or tube 116 including an open end 113 defining an opening via which the fluid can be inserted into, and taken from, the reservoir. The tube 116 includes a visible outer surface 114. In this embodiment, the surface 114 is circularly cylindrical in shape over the entire height of the tube 116. However, it is also possible to envisage that the tube 116 is cylindrical, but not circular, or even cylindrical in part over only a fraction of its height and of its periphery. A non-cylindrical outer surface could also be envisaged, but that complicates both the manufacture and the implementation of the invention. The reservoir 110 is preferably made of plastics material, but could also be made of glass or of metal. It may present a capacity of a few milliliters, e.g. 1 milliliter (mL) to 10 mL, and preferably about 2 mL.

The fastener ring 130 can also be made of injection-molded plastics material, and, in conventional manner, it comprises a skirt engaged inside the reservoir, reception means for holding the pump 140 in place in the ring, a bearing collar 131 that comes to bear against the top end edge 113 of the reservoir 110, and optionally a bushing 132 that extends upwards from the collar 131. The function of the ring is to fasten the pump in stable manner relative to the reservoir. This stable fastening can be achieved by engaging the pump directly in the reservoir. The particular shape of the fastener ring is not critical to the present invention. However, it should be noted that the outside diameter of the collar 131 is substantially equal to the outside diameter of the tube 116 at its outer surface 114, such that the collar 131 extends upwards in register with the tube 116.

The pump 140, that is not shown in detail in the figures, includes a pump body 141 that is engaged in the ring. The pump body 141 includes an inlet that is possibly provided with a dip tube 144 that extends inside the reservoir 110 so as to take the fluid. At the opposite end, the pump body is provided with an actuator rod that moves down and up, and on which there is mounted a dispenser head 142 that serves as an actuator pushbutton in this embodiment. The user can press by means of a finger, preferably the index finger, on the pushbutton so as to actuate the pump. The pushbutton is further provided with a dispenser orifice 143 that can be of the spray type in some circumstances. Dispensing in the form of drops is also envisaged.

The cap 160 presents a top end surface 161 from which there extends a cylindrical casing 162 defining a visible outer surface. The outside diameter of the casing at the outer surface is substantially or exactly identical to the outside diameter of the tube 116 and of the collar 131, such that the cap extends upwards in register with the tube and with the collar, without creating any discontinuity. Naturally, the casing could present a shape that is not completely cylindrical.

As can be seen in FIGS. 1*a* to 1*d*, the sample dispenser presents a regular and generally cylindrical or tubular shape. The dispenser presents both a longitudinal plane and a longitudinal axis of symmetry. The cap includes a bottom end that can come into abutment against the collar 131, and into rubbing contact with the bushing 132.

In the invention, the dispenser includes reception means 111 that are formed in the reservoir 110 in the form of longitudinal grooves that extend over all or part of the height of the tube 116 of the reservoir. The grooves are constituted by two grooves that extend longitudinally in diametrally opposite manner. The grooves can extend from the bottom 115 and rise along the tube 116 into the proximity of the top open end 113. The grooves have two opposite walls 1111 that extend substantially parallel. However, it is possible to envisage that the walls 1111 extend with a relative angle. The walls 1111 are interconnected at one of their longitudinal edges by a bottom core 1110, whereas the other longitudinal edges define an access opening into the groove. The opposite walls 1111 are connected to the outer surface 114 of the tube 116. This is shown clearly in FIG. 1*c*. It can thus be seen in the figure that the two grooves 111 extend in opposite manner relative to the axial axis of symmetry of the dispenser in which the dip tube 144 extends. The access openings to the grooves are diametrally opposite.

Figure 1B:
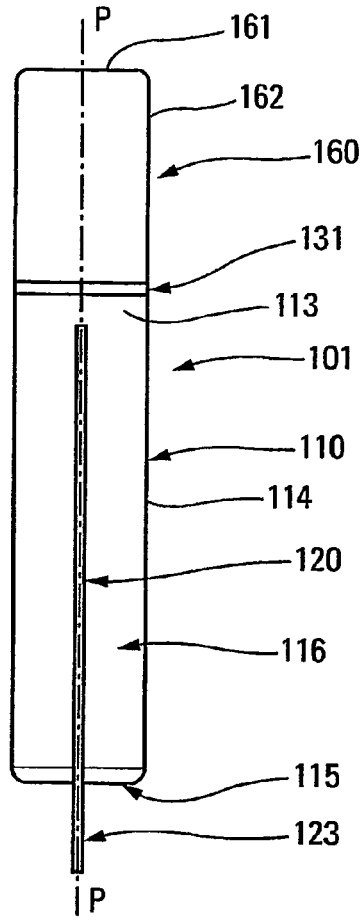
FIG. 1*b* is a side view of the FIG. 1 dispenser assembly.
Figure 1C:
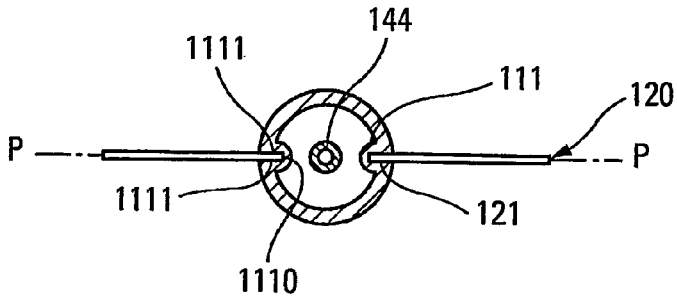
FIG. 1*c* is a horizontal cross-section view on section line A-A in FIG. 1*a;*
Figure 1D:
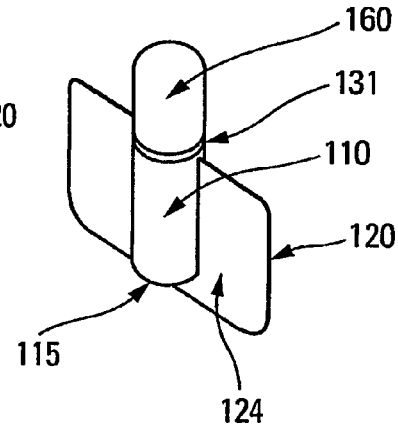
FIG. 1*d* is a perspective view of the dispenser assembly as seen from above and from the side.

In the invention, both opposite longitudinal grooves 111 extend in a fastener plane P that can be seen in FIGS. 1*b* and 1*c*. The fastener plane P intersects the dispenser 101, dividing it into two portions that are symmetrical and identical, except at the dispenser orifice 143. The fastener plane P extends in the plane of symmetry of the dispenser, or in such a manner that the axis of symmetry of the dispenser extends in the fastener plane P. This depends on the configuration of the dispenser, in particular of its reservoir and of its cap. The fastener plane could extend perpendicularly to the plane of symmetry of the dispenser, or parallel thereto, but in offset manner.

It is possible to form the walls 1111 with profiles, notches, ruptures, or a slope, while preserving a substantially longitudinal configuration extending in the fastener plane P. It is also possible to form the bottom core 110 with such profiles, notches, or a slope.

The set of two grooves defines a reception portion that advantageously extends in the fastener plane P.

The pack 120 can advantageously be made from a plane sheet of plastics material, metal, or a combination of the two. The pack is preferably completely plane so as to extend only in a single plane. The pack preferably presents a wall thickness that is substantially or completely constant. However, it is possible to imagine embodiments in which the pack is not completely plane, so as to form profiles, grooves, moldings, or rims that extend out from the general plane, without losing the overall substantially plane appearance of the pack. By way of example, it is possible to envisage that the pack is corrugated. It is even possible for the pack to present an open or closed shape that is cylindrical or tubular in part.

In the invention, the pack 120 defines a fastener housing 122, which, in this embodiment, is in the form of a cut-out formed starting from an outer edge of the pack. The housing 122 thus opens outwards at an access passage 126 defined by edges 127. Below the edges 127, the housing 122 forms two opposite longitudinal edges 121 that are interconnected by a bottom edge 1235. In the invention, all or part of the edges 127, 121, and 1235 can form a fastener zone for co-operating with the dispenser 101 at the reception means. The fastener zone is preferably formed by the opposite longitudinal edges 121 that thus form two fastener zone portions that define between them a housing gap for housing the dispenser 101.

The housing 122 occupies a longitudinal middle or central position in the embodiment in FIGS. 1*a* to 1*d*. The housing 122 thus separates two side fins 124 that are interconnected by a bottom plate 123.

In the invention, the fastener zone 121 of the pack 120 is situated in a single plane. All of the edges forming the housing 122 preferably extend in a single plane. Even more preferably, the entire pack extends in a single plane.

In the invention, the fastener zone of the pack co-operates with the reception means of the dispenser so as to fasten the pack 120 to the dispenser 101. More precisely and preferably, the opposite longitudinal edges 121 of the housing 122 are inserted into the respective opposite longitudinal grooves 111 of the dispenser. Naturally, the wall thickness of the pack at the edges 121 is substantially equal to the width of the grooves taken between the walls 1111. It is even preferable for the wall thickness of the pack to be slightly greater than the width of the grooves, thereby securing the edges of the housing in the grooves. The edges 121 can be engaged in the grooves 111 by sliding engagement along the axis in the plane P. In a variant, the pack 120 can be fitted onto the dispenser 101 sideways, in such a manner as to engage the edges 121 of the housing 122 by deforming, and then by snap-fastening.

In the embodiment shown in FIGS. 1*a* to 1*d*, the fastener edges 121 of the housing 122 extend in the same fastener plane P as the reception grooves 111. In addition, as can be seen in FIGS. 1*b* and 1*c*, the entire pack extends in the fastener plane P.

In this embodiment, the pack extends only as far as the reservoir 110, its top end stopping just below the collar 131. The edges 127 extend around the outer surface 114 of the tube. The bottom 115 can come into abutment against the edge 1235 and the plate 123.

The dispenser 101 is thus held in completely centered manner in the pack 120. A simple mechanical fastening by clamping or by friction can be sufficient to hold the dispenser in the pack. However, it is also possible to envisage that the edges 121 of the housing 122 are fastened by adhesive or by heat-sealing in the grooves 111 of the dispenser.

The pack 120 can present a certain degree of rigidity against deformation, such that the outer lateral edges can serve as handle zones for holding the dispenser assembly in such a manner as to be able to actuate the pump by means of the index finger. The overall configuration of the dispenser assembly is that of a conventional dispenser constituted by a reservoir in the form of a flask on which there is mounted a dispenser pump.

As a result of its completely or substantially plane configuration, the pack constitutes a large display zone for displaying any form of markings or information relating to the packaged fluid. Furthermore, it should be observed that the pack leaves the dispenser completely visible, except at the reception means. As a result, the dispenser can also serve as a marking display zone.

In order to use the dispenser assembly, the user can take hold of it in one hand, remove the cap 160 with the other hand, and actuate the dispenser head by means of the same hand that holds the dispenser assembly via the pack 120. In a variant, when the pack is not fastened in permanent manner to the dispenser, the user can remove the pack before use.

Figure 2A:
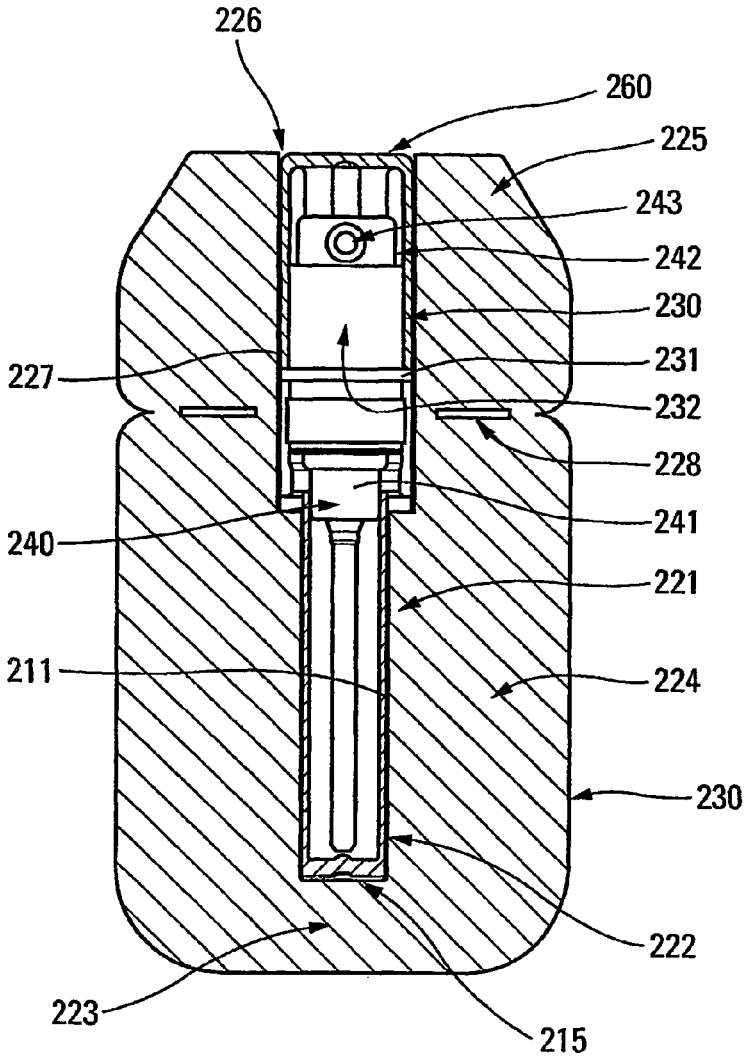
FIG. 2*a* is a front view of a dispenser assembly constituting a second embodiment.
Figure 2B:
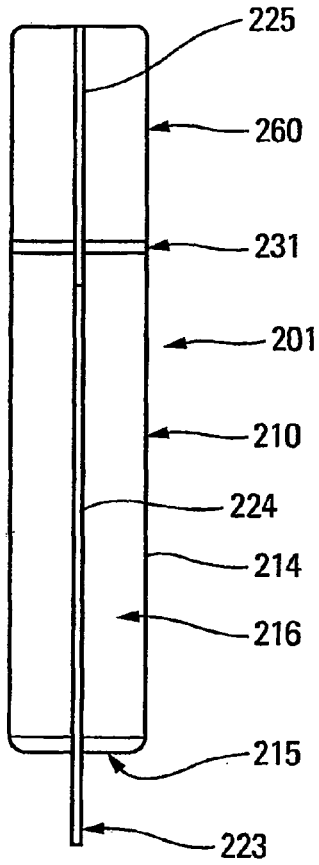
FIG. 2*b* is a side view of the FIG. 2*a* dispenser assembly.

The embodiment in FIGS. 2*a*, 2*b*, 2*c*, and 2*d* implements a dispenser 201 that can be completely or substantially identical to the dispenser in the first embodiment. The pack 220 differs from the pack in the first embodiment in that it further comprises two lateral extensions 225 that extend upwards in register with fins 224. The extensions 225 are connected to the fins 224 by lines of weakness 228 for separating the extensions 225 from the remainder of the pack. The extensions 225 extend in such a manner as to extend the housing 222 upwards, defining extended edges 227. With reference to FIGS. 2*a* and 2*d*, it can clearly be seen that the extensions 225 extend on either side of the cap 260. Thus, even once the cap 260 has been removed, because of the presence of the two lateral extensions 225, it is very difficult to actuate the dispenser by pressing on the dispenser head. In contrast, once the extensions 225 have been torn off, the pack can present a general configuration that is substantially similar to the configuration in the first embodiment. It is then easily possible to actuate the dispenser.

The extensions 225 make it possible to increase the marking display area, and make it possible to provide a first-use safety function that guarantees to the user that the device has not yet been used.

It should be noted that the housing 222 of this second embodiment also opens outwards at an access passage 226. The pack 220 can be fastened to the dispenser 201 by any means: clamping, adhesive, heat-sealing.

In the third embodiment in FIGS. 3*a* and 3*b*, the pack 320 can be identical to the pack referenced 220 in the second embodiment. The dispenser 301 differs from those in the first and second embodiments in that the cap 360 includes reception means 366 that are also advantageously in the form of opposite longitudinal grooves. The grooves 366 also extend in the common fastener plane P, visible in FIG. 3*b*. In this embodiment, the grooves 366 are formed by lateral reinforcements that project from the cylindrical casing 362 of the cap 360. The edges 327 of the extensions 325 formed by the pack 320 are engaged in the grooves 366 on either side of the cap. The extensions 325 can be held merely as a force fit, or else they can be fastened by means of an adhesive or by heat-sealing. Given that the pack is fastened to the cap 360, and that the pack is also fastened to the reservoir 310 by engaging the edges 321 in the grooves 311, it is impossible to remove the cap 360 without separating the extensions 325 from the remainder of the pack at the lines of weakness 328. Consequently, in this embodiment, the pack also fulfils a real function of guaranteeing that the device has not yet been used, by preventing the cap from being removed without removing the pack.

The edges 327 form fastener zones portions defining a second housing gap for housing the dispenser. The two fastener portions extend in the same single fastener plane P as the grooves 311 and the edges 321.

Figure 4A:
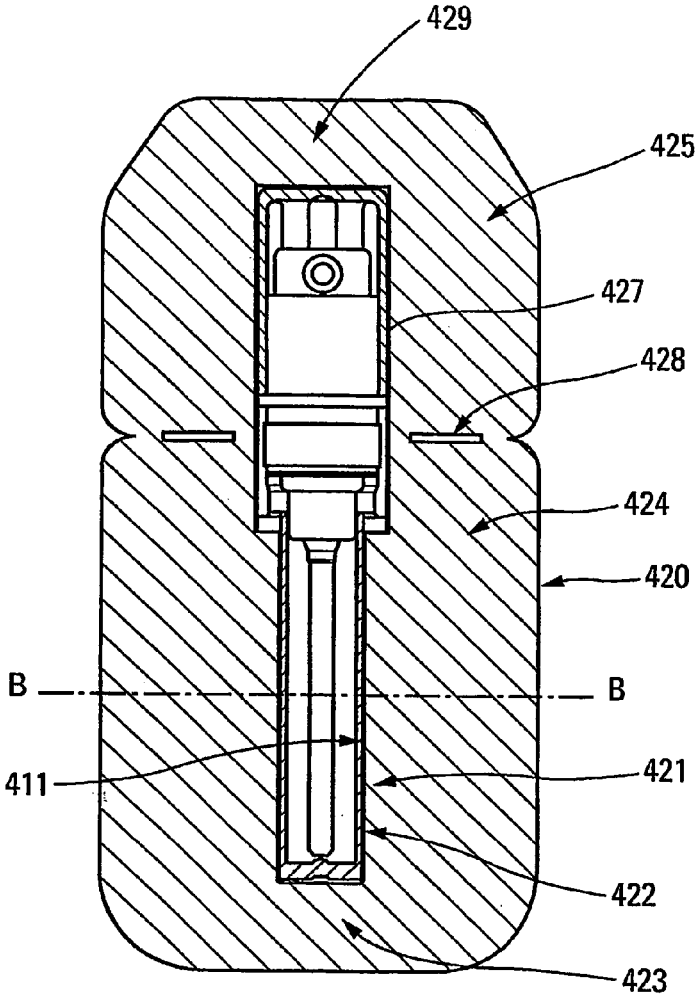
FIG. 4*a* is a front view of a dispenser assembly constituting a fourth embodiment of the invention.
Figure 4B:
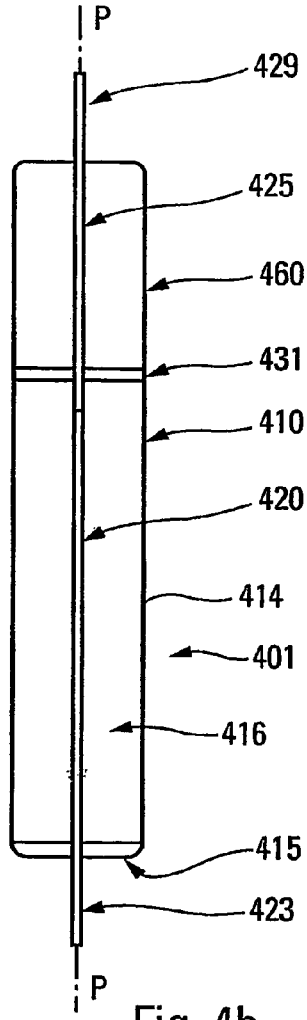
FIG. 4*b* is a side view of the FIG. 4*a* dispenser assembly.
Figure 4C:
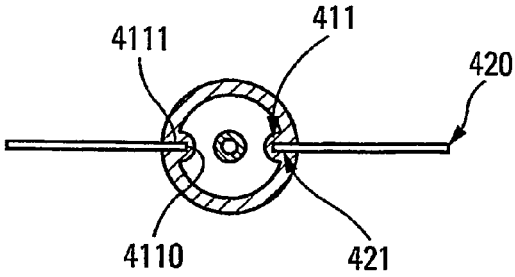
FIG. 4*c* is a horizontal cross-section view on section line B-B in FIG. 4*a;*
Figure 4D:
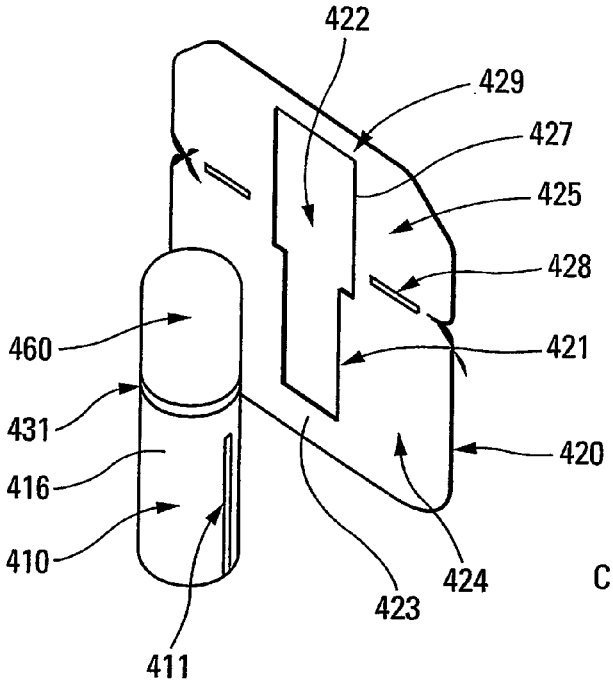
FIG. 4*d* is a perspective view as seen from above of the dispenser assembly constituting the fourth embodiment of the invention, and showing the dispenser separate from its pack.
Figure 4E:
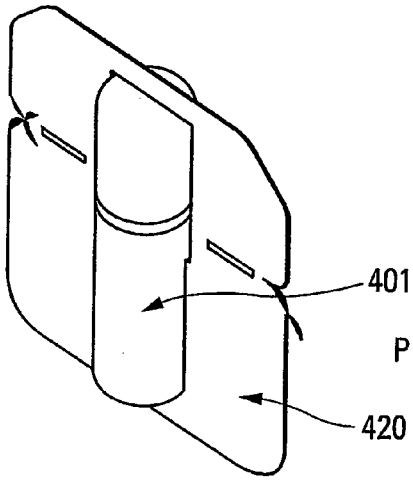
FIG. 4*e* is a perspective view of a dispenser assembly constituting a fourth embodiment of the invention, and showing the pack fastened to the dispenser.

In the fourth embodiment in FIGS. 4*a* to 4*f*, the dispenser 401 can be identical to the dispenser in the first and second embodiments. Only the reservoir 410 forms reception means situated in the single fastener plane P, as can be seen in FIG. 4*d*. The pack 420 is provided with an extension portion 425 that extends around the cap 460. The extension portion 425 differs from the extensions 225 and 325 in the second and third embodiments in that it also includes a top connection portion 429 that extends over the cap 460. Consequently, the housing 422 defined by the pack 420 differs from the above-described housings in that it does not include an outwardly-open access passage. The housing is thus in the form of a cut-out or of a window within the pack. The extension portion 425 offers an even larger display area than the first, second, third, and fourth embodiments, and also fulfils a first-use safety function by preventing the cap from being removed. It is only once the extension portion 425 has been torn off at the lines of weakness 428 that it is possible to actuate the dispenser.

Figure 5A:
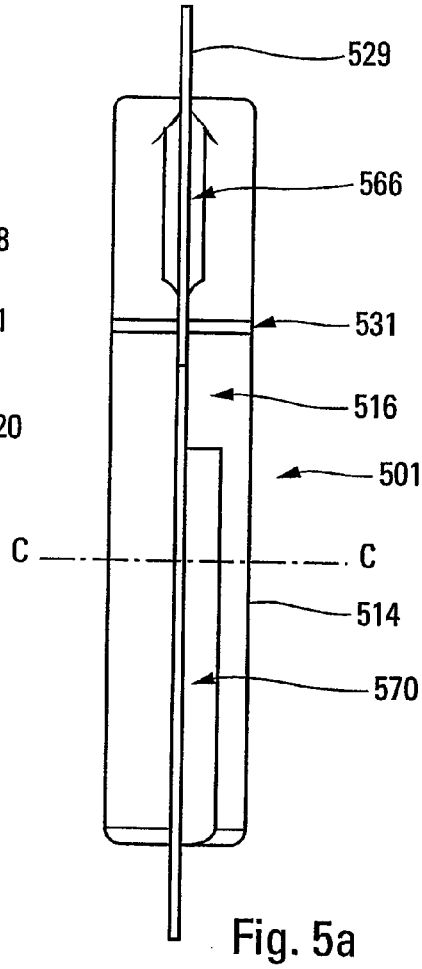
FIG. 5*a* is a side view of a dispenser assembly constituting a fifth embodiment of the invention.
Figure 5B:
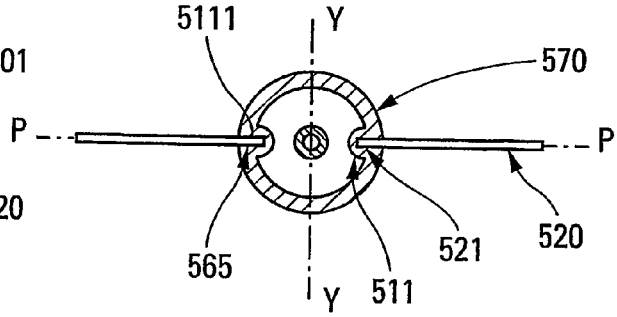
FIG. 5*b* is a horizontal cross-section view on section line C-C in FIG. 5*a;*
Figure 5C:
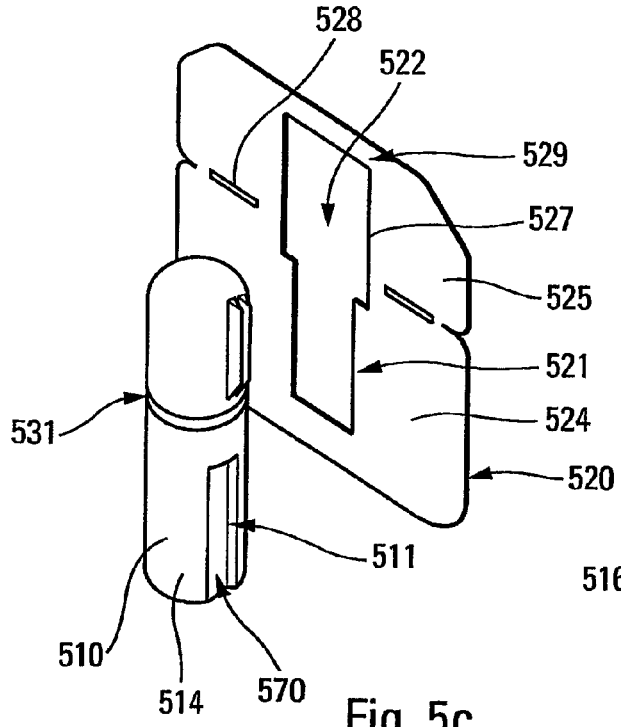
FIG. 5*c* is a perspective view as seen from above of a dispenser assembly constituting the fifth embodiment of the invention, and showing the dispenser separate from the pack.
Figure 5D:
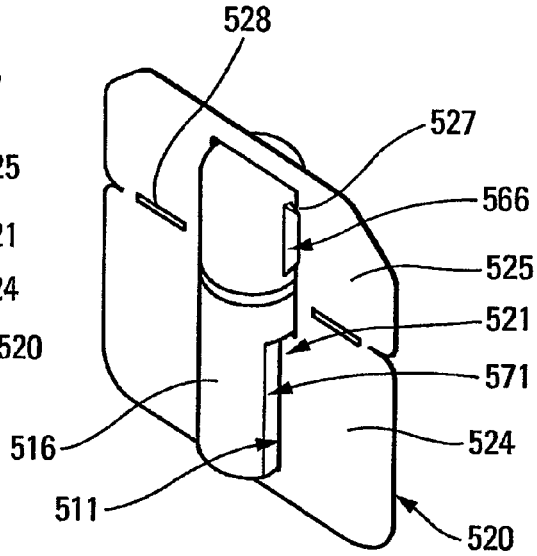
FIG. 5*d* is a perspective view as seen from above of a dispenser assembly constituting the fifth embodiment of the invention, and showing the pack fastened to the dispenser.

In the fifth embodiment in FIGS. 5*a* to 5*d*, the pack 520 can be identical to the pack in the fourth embodiment of FIGS. 4*a* to 4*f*. The dispenser 501 includes reception means 566 on the cap 560, as in the third embodiment. In addition, each of the reception means 511 in the reservoir 510 includes an access wall 570 that extends longitudinally over all or part of the length of the groove. Each of the longitudinal access walls 570 presents a component that extends substantially perpendicularly to the fastener plane P, as can be seen in FIG. 5*b*. The access wall 570 shortens the width of the wall 5111 that forms the groove 511. It is thus easier to insert the edges 521 forming the fastener zone of the pack 520 into the reception means formed by the grooves 511. It suffices to place the pack 520 on the dispenser by sliding the edges 521 over the two access walls 570. By pressing the pack onto the dispenser, the edges slide until they become snap-fastened in the grooves 511. The access walls 570 create an additional discontinuity in the completely cylindrical shape of the outer surface 514 of the tube of the reservoir.

Figure 6A:
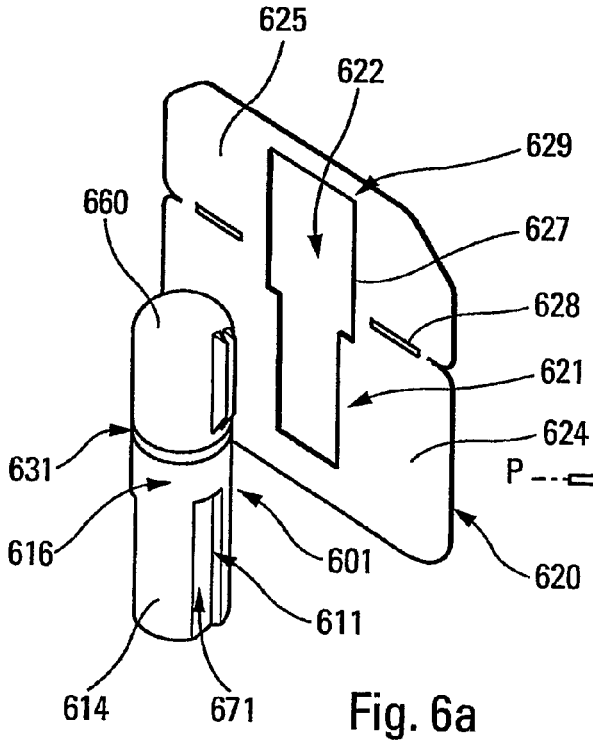
FIG. 6*a* is a perspective view as seen from above of a dispenser assembly constituting a sixth embodiment of the invention, and showing the pack separate from the dispenser.
Figure 6B:
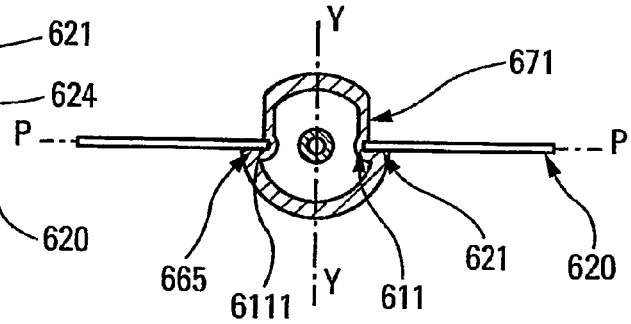
FIG. 6*b* is a horizontal cross-section view of a dispenser assembly constituting the sixth embodiment of the invention.

In the sixth embodiment in FIGS. 6*a* and 6*b*, the pack 620 can be identical to the pack in the fifth embodiment. In contrast, the dispenser 601 differs from the above-described dispenser in that it does not include reception means on the cap. Furthermore, in this embodiment, the grooves 611 are in the form of V-grooves that practically do not have a bottom core. Each V-groove thus includes a bearing wall 6111 that is situated in the fastener plane P, and an engagement or access wall 671 that extends substantially perpendicularly to the fastener plane. However, the V-groove can provide a snap-fastening groove for the edges 621 of the pack. It is also possible to envisage fastening the pack on the bearing wall 6111 by adhesive or by heat-sealing.

In all of the embodiments, the reception means formed by the dispenser, and the fastener zone formed by the pack, extend in the same fastener plane P. The fastener zone can be formed by one or two pairs of fastener portions, each formed by a pair of edges that co-operate with the reservoir and/or with the cap.

In all of the embodiments, the pack includes a housing that extends in a single plane. This signifies that the housing is two-dimensional, and not three-dimensional like a box or a casing. The two-dimensional character of the housing is characterized in that can be implemented independently.

Although not shown, it is also possible to envisage that the fastener plane extends transversely or perpendicularly to the axis of symmetry of the dispenser.

In order to make it easier to fasten the pack on the dispenser, it is also possible to provide the fastener zone or the reception means with means for improving fastening. By way of example, it is possible to envisage that the grooves present a particular profile that is complementary to a profile formed by the pack. It is also possible to envisage that the fastener zone also extends along the connection edge that connects the lateral edges. It is also possible to envisage that the bottom of the reservoir of the dispenser is provided with a reception groove.

The invention claimed is:

1. A fluid dispenser assembly comprising:

a fluid dispenser (101; 201; 301; 401; 501; 601); and a pack (120; 220; 320; 420; 520; 620) for co-operating with the dispenser in such a manner as to fasten the pack to the dispenser, the pack including a fastener zone (121; 221; 321, 327; 421; 521, 527; 621), and the dispenser including reception means (111; 211; 311, 366; 411; 511, 566; 611) for receiving the fastener zone, the assembly being characterized in that the reception means comprise at least one set of two opposite longitudinal grooves (111; 211; 311, 327; 411; 511, 527; 611) for receiving the fastener zone (121; 221; 321, 366; 421; 521, 566; 621) of the pack;

wherein the at least one set of two opposite longitudinal grooves face away from each other in opposite directions;

wherein the at least one set of two opposite longitudinal grooves extend in a direction that is substantially parallel with a direction of actuation of the fluid dispense;

wherein the reception means and the fastener zone extend in a fastener plane (P);

wherein the dispenser presents a generally cylindrical shape defining a longitudinal axis of symmetry that extends in said fastener plane; and wherein the pack is plane and thin.

2. A dispenser assembly according to claim 1, in which the dispenser (101; 201; 301; 401; 501; 601) presents a longitudinal axis that extends in said fastener plane (P).

3. A dispenser assembly according to claim 1, in which the pack (120; 220; 320; 420; 520; 620) includes a housing (122; 222; 322; 422; 522; 622) that is plane, at least in part, defining substantially plane edges forming the fastener zone (121; 221; 321, 327; 421; 521, 527; 621).

4. A dispenser assembly according to claim 3, in which the fastener zone comprises two facing zone portions (121; 221; 321, 327; 421; 521, 527; 621), defining between them a housing gap for co-operating with the reception means (111; 211; 311, 366; 411; 511, 566; 611) of the dispenser.

5. A dispenser assembly according to claim 1, in which the pack (420; 520; 620) forms a closed housing (422; 522; 622) that is in the form of a cut-out within the pack, the dispenser (401; 501; 601) being completely surrounded by the pack.

6. A dispenser assembly according to claim 1, wherein the pack (120; 220; 320; 420; 520; 620) is made from a plane sheet.

7. A dispenser assembly according to claim 1, in which the dispenser (101; 201; 301; 401; 501; 601) includes a reservoir (110; 210; 310; 410; 510; 610) forming a body (116; 216; 316; 416; 516; 616), the reception means (111; 211; 311; 411; 511; 611) being formed by said body.

8. A dispenser assembly according to claim 1, in which the dispenser (301; 501) includes a removable protective cap (360; 560), the reception means (366; 566) being formed by said cap.

9. A dispenser assembly according to claim 1, in which the dispenser includes a reservoir (110; 210; 310; 410; 510; 610) having side walls (114; 214; 314; 414; 514; 614), a bottom (115; 215; 315; 415; 515; 615), and an opening (113; 213; 313; 413; 513; 613), the side walls forming the at least one set of two opposite longitudinal grooves (111; 211; 311; 411; 511; 611) that extend over at least a fraction of the height of the walls between the bottom and the opening.

10. A dispenser assembly according to claim 1, in which each groove (111; 211; 311; 411; 511; 611) comprises two substantially opposite longitudinal walls (1111; 2111; 3111; 4111; 5111; 6111) that are interconnected by a bottom core (1110; 2110; 3110; 4110; 5110; 6110), said walls extending substantially in the fastener plane (P).

11. A dispenser assembly according to claim 1, in which each groove comprises a longitudinal access wall (570) that extends substantially perpendicularly to the fastener plane (P).

12. A dispenser assembly according to claim 1, in which each groove (611) defines a longitudinal fastener wall (6111) that extends substantially in the fastener plane (P), and an access wall (671) that extends substantially perpendicularly to the fastener plane (P).

13. A dispenser assembly according to claim 1, in which the pack is engaged into the grooves of the dispenser by sliding.

14. A fluid dispenser assembly comprising:

a fluid dispenser comprising a plurality of longitudinal grooves, wherein the plurality of longitudinal grooves face in different directions and wherein the plurality of longitudinal grooves extend in a direction substantially parallel to a direction of actuation of the fluid dispenser; and a card comprising a plurality of edges, wherein the plurality of edges are configured to be inserted into a respective one of the plurality of longitudinal grooves such that the card is attached to the fluid dispenser wherein the fluid dispenser comprises a cylindrical shape defining a longitudinal axis of symmetry that extends in a plane of the card.

15. A fluid dispenser assembly according to claim 14, wherein the plurality of longitudinal grooves comprise two longitudinal grooves formed on opposite sides of a reservoir;

wherein the card comprises two edges facing each other such that the two edges are inserted into the two longitudinal grooves.

16. A fluid dispenser assembly according to claim 14, wherein the card comprises a tear-away portion;

wherein the tear away portion extends to an end of the fluid dispenser that is opposite an end of the fluid dispenser that contains the longitudinal grooves.

17. A fluid dispenser assembly according to claim 14 further comprising a removable cap that covers a dispenser orifice;

wherein the cap is attached to a tear-away portion of the card.

18. A fluid dispenser assembly according to claim 14, wherein the card extends completely around the fluid dispenser, such that the card prevents actuation of the fluid dispenser.

19. A fluid dispenser assembly according to claim 18, wherein the card comprises a tear away portion that when torn away allows actuation of the fluid dispenser.

* * * * *